US012630966B2

(12) United States Patent
Kang et al.

(10) Patent No.: US 12,630,966 B2
(45) Date of Patent: May 19, 2026

(54) APPARATUS AND METHOD FOR MEASURING HUMIDITY FOR DRYER

(71) Applicant: LG ELECTRONICS INC., Seoul (KR)

(72) Inventors: Byeonggeun Kang, Seoul (KR); Mangeun Kim, Seoul (KR); Hyunjin Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 954 days.

(21) Appl. No.: 17/884,164

(22) Filed: Aug. 9, 2022

(65) Prior Publication Data

US 2023/0340714 A1 Oct. 26, 2023

(30) Foreign Application Priority Data

Apr. 25, 2022 (KR) ..... 10-2022-0051039

(51) Int. Cl.
*D06F 58/20* (2006.01)
*D06F 103/08* (2020.01)

(52) U.S. Cl.
CPC ..... *D06F 58/20* (2013.01); *D06F 2103/08* (2020.02)

(58) Field of Classification Search
CPC .. D06F 58/20; D06F 2103/08; D06F 2103/10; D06F 2105/12; D06F 58/38; D06F 34/26; G01N 27/223
See application file for complete search history.

(56) References Cited

U.S. PATENT DOCUMENTS 6,098,310 A * 8/2000 Chen ..... D06F 58/38 34/495
2003/0214310 A1* 11/2003 McIntosh ..... G01N 27/223 324/658

(Continued)

FOREIGN PATENT DOCUMENTS

CN 112779738 5/2021
JP 2017046896 3/2017

(Continued)

OTHER PUBLICATIONS

Liu Hong, et al., "Humidity Sensors with Shielding Electrode Under Interdigitated Electrode", Sensors, vol. 19, No. 3, Feb. 2019, XP093005377, 11 pages.

(Continued)

*Primary Examiner* — David J Laux
(74) *Attorney, Agent, or Firm* — LEE, HONG, DEGERMAN, KANG & WAIMEY

(57) ABSTRACT

Provided are an apparatus and method for measuring humidity of an object to be dried in a dryer. The apparatus for measuring the humidity for the dryer includes a capacitance measuring sensor configured to measure an amount of capacitance change that is changed due to humidity of an object to be dried, which is put into the dryer; a shield configured to shield noise generated in the dryer; and a processor electrically connected to the capacitance measuring sensor and the shield, wherein the processor is configured to apply a second signal having the same waveform and the same voltage to the capacitance measuring sensor and the shield and acquire the amount of capacitance change, based on the first signal output from the capacitance measuring sensor so as to measure an amount of humidity change of the object to be dried.

13 Claims, 20 Drawing Sheets

(56) References Cited

U.S. PATENT DOCUMENTS

| | | | | |
|---|---|---|---|---|
| 2004/0051540 | A1* | 3/2004 | Tomasi | D06F 58/04 324/664 |
| 2019/0187086 | A1* | 6/2019 | Burkey | H04L 67/568 |
| 2020/0002873 | A1* | 1/2020 | Chae | G06N 3/08 |
| 2020/0181824 | A1* | 6/2020 | Vitali | G01N 27/223 |

FOREIGN PATENT DOCUMENTS

| | | |
|---|---|---|
| KR | 1020110087925 | 8/2011 |
| KR | 1020190093605 | 8/2019 |
| WO | 2020041440 | 2/2020 |

OTHER PUBLICATIONS

European Patent Office Application Serial No. 22186257.6, Search Report dated Dec. 19, 2022, 10 pages.
PCT International Application No. PCT/KR2022/008322, International Search Report dated Jan. 16, 2023, 10 pages.

* cited by examiner

APPARATUS AND METHOD FOR MEASURING HUMIDITY FOR DRYER

CROSS-REFERENCE TO RELATED APPLICATIONS

Pursuant to 35 U.S.C. § 119(a), this application claims the benefit of earlier filing date and right of priority to Korean Patent Application No. 10-2022-0051039, filed on Apr. 25, 2022, the contents of which are hereby incorporated by reference herein in its entirety.

BACKGROUND

The present disclosure relates to an apparatus and method for humidity of an object to be dried in a dryer.

In recent years, due to a change in consumer perception that a dryer removes fine dusts from clothes, as the sales volume of the dryer increases, the amount of dryer used is also increasing.

As such, as the dryer is used more frequently, consumer complaints about the limitation in which clothes are not sufficiently dried and the limitation of excessive drying of the clothes have been received.

The reason is because of the technical limitations of a contact electrode sensor that sense the dry state through the contact with the cloth, and it is impossible to sense the dry state of the cloth that the consumer feels.

Therefore, to know an exact drying completion time for this reason, the development of a non-contact humidity sensor for the dryer capable of increasing in accuracy and precision of measuring humidity of laundry in the dryer is required.

SUMMARY

An object of the present disclosure is to solve the foregoing limitations and other limitations.

Embodiments provide an apparatus and method for measuring humidity for a dryer, in which noise on a measurement signal is removed by using a capacitance measuring sensor and an active shield, and a signal-to-noise ratio is minimized to accurately and precisely measure humidity of an object to be dried.

Embodiments also provide an apparatus and method for measuring humidity for a dryer, in which a humidity sensing range is adjusted to an optimal area by using an active shield to accurately and precisely measure humidity of an object to be dried, which is disposed at a specific area.

In one embodiment, an apparatus for measuring humidity for a dryer includes: a capacitance measuring sensor configured to measure an amount of capacitance change that is changed due to humidity of an object to be dried, which is put into the dryer; a shield configured to shield noise generated in the dryer; and a processor electrically connected to the capacitance measuring sensor and the shield, wherein the processor is configured to: apply a second signal having the same waveform and the same voltage to the capacitance measuring sensor and the shield; and acquire the amount of capacitance change, based on the first signal output from the capacitance measuring sensor so as to measure an amount of humidity change of the object to be dried.

In another embodiment, a method for measuring humidity in an apparatus for measuring humidity for a dryer, which comprises a processor electrically connected to a capacitance measuring sensor and a shield, includes: applying a second signal having the same waveform and the same voltage to the capacitance measuring sensor and the shield; acquiring an amount of capacitance change, based on a first signal output from the capacitance measuring sensor; and measuring an amount of humidity change of an object to be dried, based on the acquired amount of capacitance change.

The details of one or more embodiments are set forth in the accompanying drawings and the description below. Other features will be apparent from the description and drawings, and from the claims.

DETAILED DESCRIPTION OF THE EMBODIMENTS

Hereinafter, embodiments disclosed in this specification is described with reference to the accompanying drawings, and the same or corresponding components are given with the same drawing number regardless of reference number, and their duplicated description will be omitted. Furthermore, terms, such as a "module" ad a "unit", are used for convenience of description, and they do not have different meanings or functions in themselves. Moreover, detailed descriptions related to well-known functions or configurations will be ruled out in order not to unnecessarily obscure subject matters of this specification. However, this does not limit this specification within specific embodiments and it should be understood that the present disclosure covers all the modifications, equivalents, and replacements within the idea and technical scope of this specification.

It will be understood that although the ordinal numbers such as first and second are used herein to describe various elements, these elements should not be limited by these numbers. The terms are only used to distinguish one component from other components.

It will also be understood that when an element is referred to as being "connected to" or "engaged with" another element, it can be directly connected to the other element, or intervening elements may also be present. It will also be understood that when an element is referred to as being 'directly connected to' another element, there is no intervening elements.

Figure 1A:
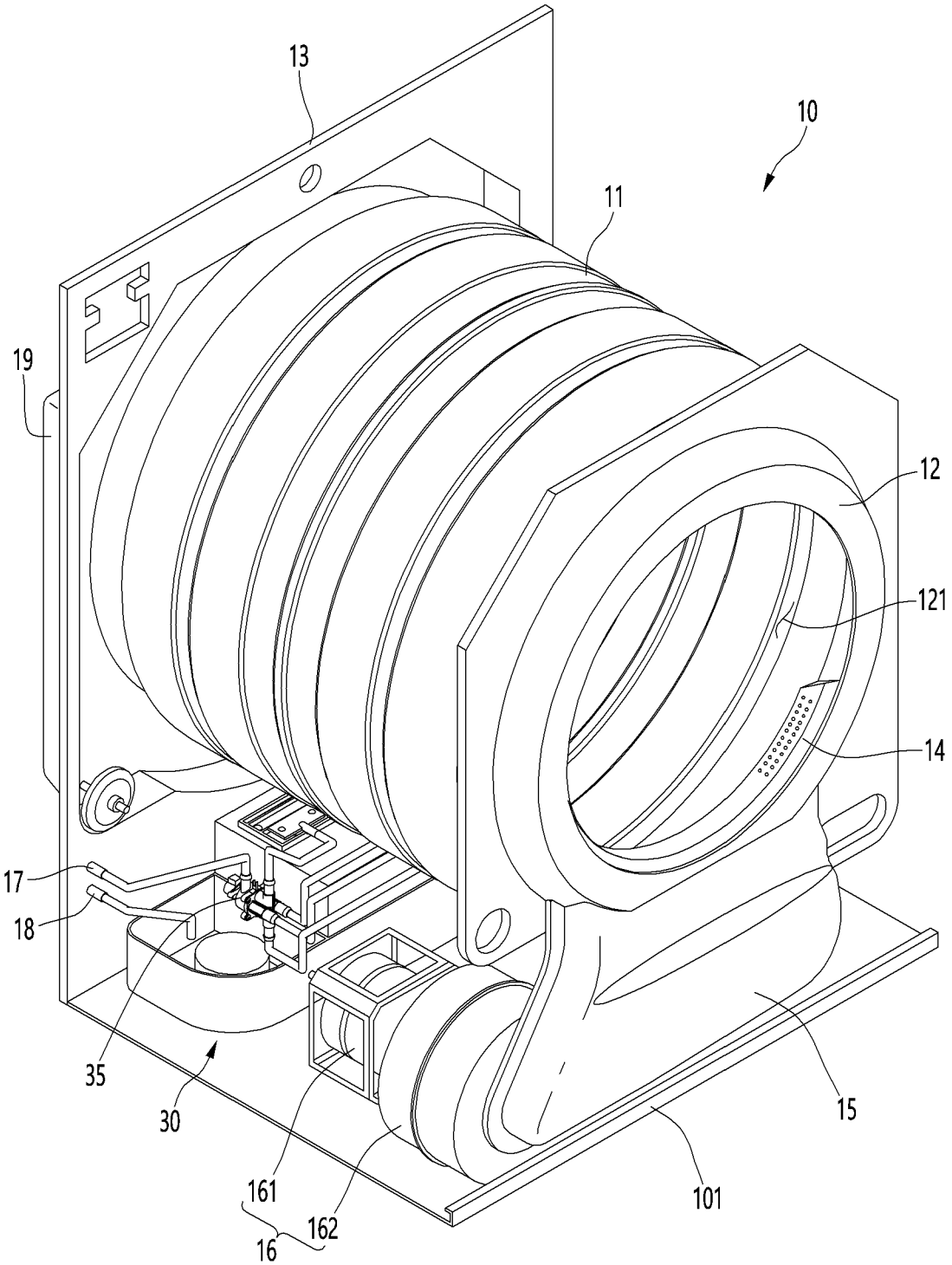
FIGS. 1A and 1B are perspective views illustrating a dryer and a humidity sensor for the dryer according to an embodiment.
Figure 1B:
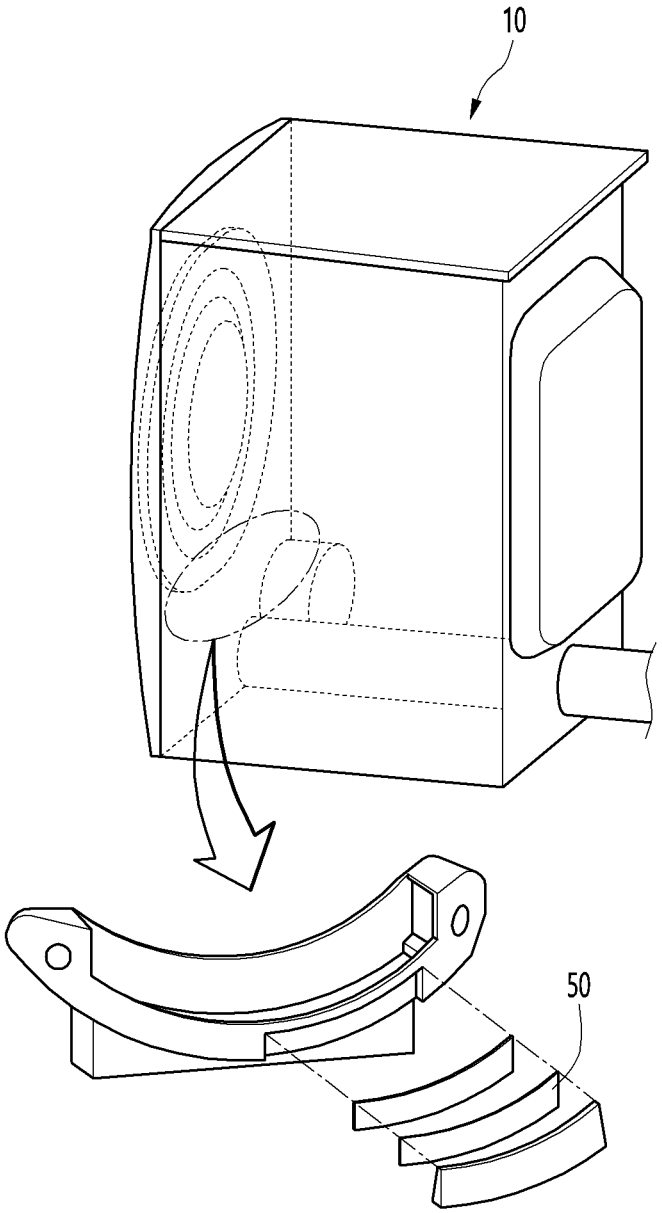
Figure 2:
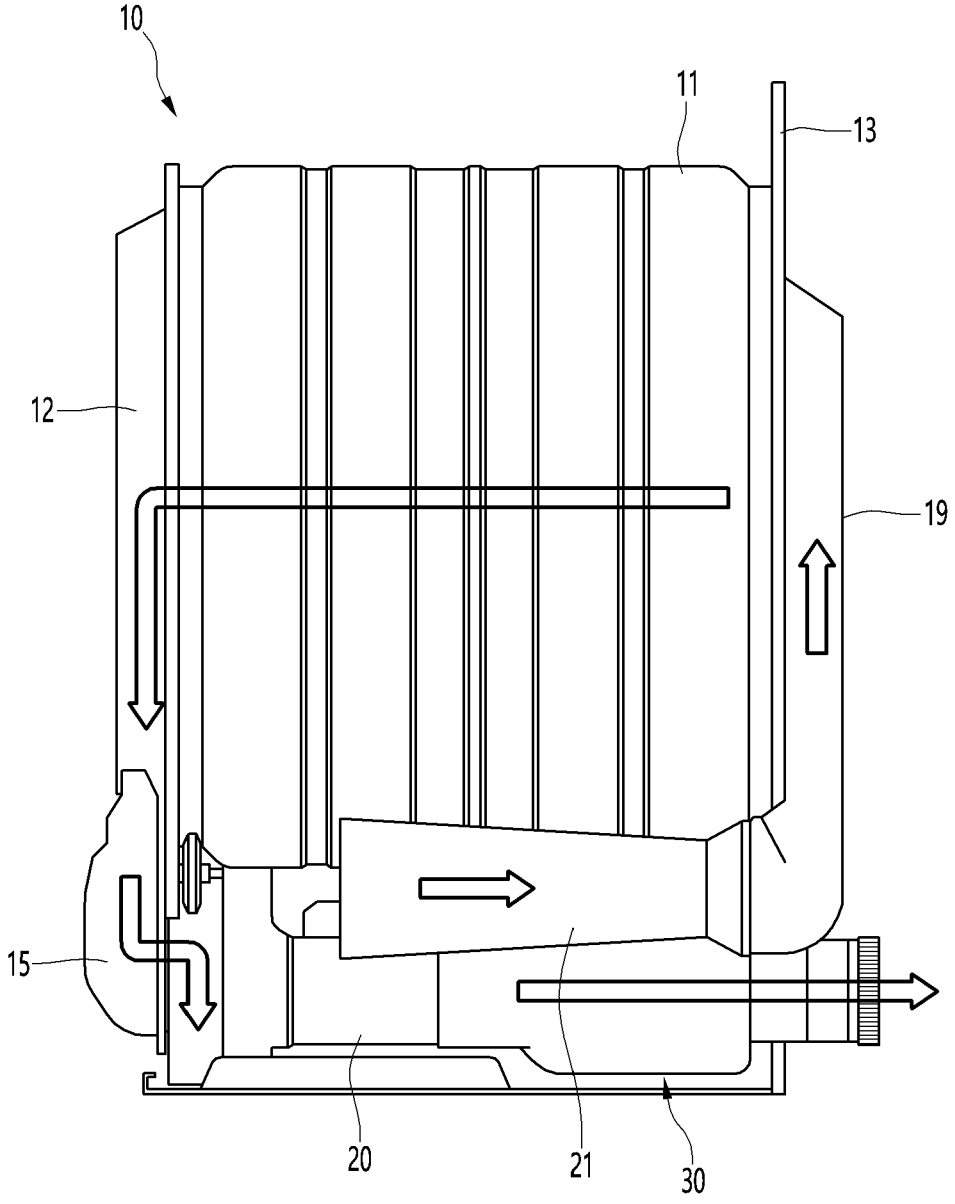
FIG. 2 is a side view illustrating the dryer according to an embodiment.
Figure 3:
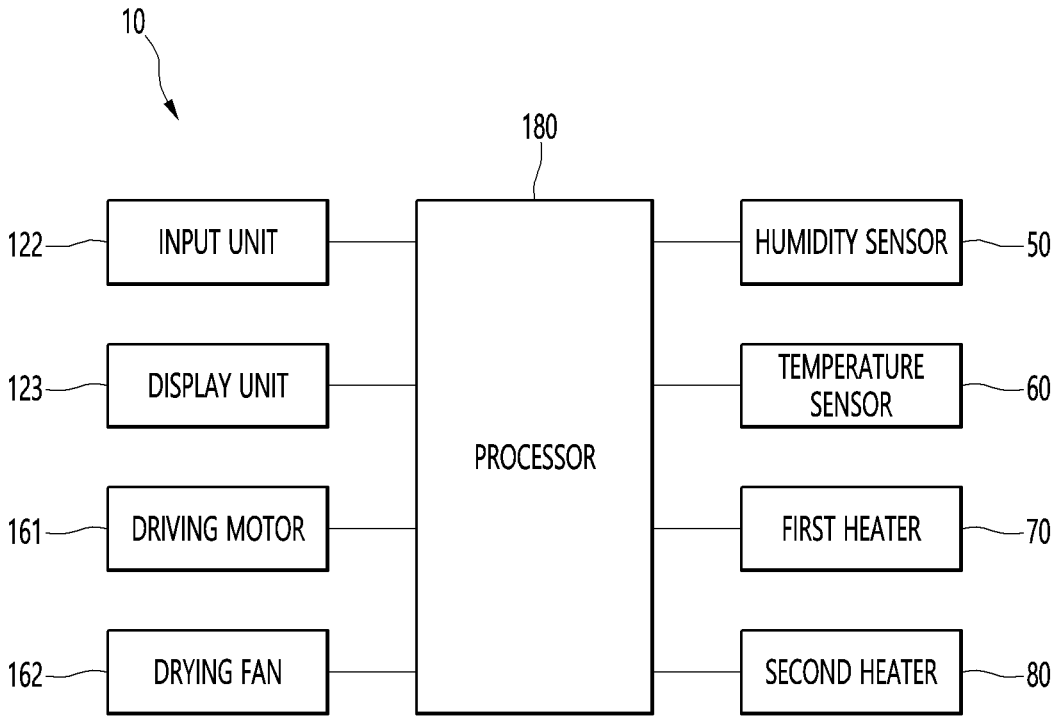
FIG. 3 is a block diagram for explaining a configuration of the dryer according to an embodiment.

FIGS. 1A and 1B are perspective views illustrating a dryer and a humidity sensor for the dryer according to an embodiment, FIG. 2 is a side view illustrating the dryer according to an embodiment, and FIG. 3 is a block diagram for explaining a configuration of the dryer according to an embodiment.

In the following drawings, although a dryer 1 is described as an example of a laundry treatment apparatus, embodiments may not be applied only to the dryer 1, but be applied to various laundry treatment apparatuses such as a washing machine having a drying function.

In addition, in the embodiments, it is not limited to a circulating dryer in which air inside the dryer is circulated, and it is to be noted that it is also applicable to an exhaust dryer.

Referring to FIGS. 1A to 3, a dryer 10 may include a drying drum 11 into which an object to be dried (hereinafter, referred to as a drying object) is put, a humidity sensor 50 mounted on an inner circumferential surface of the drying drum 11, a front cabinet 12 supporting a front surface of the drying drum 11, a blocking member 14 mounted to a bottom of the front cabinet 12, a rear cabinet 13 supporting a rear surface of the drying drum 11, and a lint filter cleaner 30 provided below the drying drum 11.

In detail, the humidity sensor 50 may be disposed in the drying drum 11 to sense humidity of the drying drum 11.

In an embodiment, the humidity sensor 50 may be disposed at a position, which is in contact with laundry, of the blocking members 14 mounted on the bottom of the drying drum 11 to sense humidity.

In addition, the dryer 10 may further include a suction duct 21 suctioning air to be supplied to the drying drum 11, a rear duct 19 connecting the suction duct 21 to an air inlet hole defined in a rear surface of the suction duct 21, a guide duct 15 connected to a bottom surface of the front cabinet 12 to guide the air discharged from the drying drum 11, an air blower 16 connected to an outlet end of the guide duct 15, and an exhaust duct 20 connected to an outlet end of the air blower 16. The lint filter cleaner 30 is mounted at any point of the exhaust duct 20 so that lint contained in the air flowing along the exhaust duct 20 is filtered while passing through a lint filter assembly provided in the lint filter cleaner 30.

A middle cabinet (not shown) is provided between the front cabinet 12 and the rear cabinet 13 to cover and protect the drying drum 11 and various components disposed below the drying drum 11. The middle cabinet may define both side surfaces and a top surface of the dryer 10. A base plate 101 defining the bottom of the dryer 10 may be provided on a bottom surface of the middle cabinet, and the components may be mounted on the base plate 101.

In addition, a control panel (not shown) may be mounted at an upper side of a front surface of the front cabinet 12. The control panel may include an input unit 122 configured to select an operation mode (e.g., a drying mode) of the dryer 10, and a display unit 123 configured to display a variety of information including an operation state.

In addition, a temperature sensor 60 may be mounted at an outlet side of the drying drum 11. The temperature sensor 60 is mounted at the outlet side of the drying drum 11 to detect an outlet temperature value of the drying drum 11 (hereinafter, referred to as a "drum outlet temperature value").

For example, the temperature sensor 60 may be mounted on an inner circumferential surface of a side of the front end of the drying drum 11 and may be mounted at one side of an inner circumferential surface of the guide duct 15 connected to the outlet side of the drying drum 11.

In addition, the blocking member 14 is provided to prevent foreign substances contained in an object to be dried, for example, bulky and hard foreign substances a coin, a ballpoint pen, and the like from being suctioned into the guide duct 15 during the drying process. The foreign substances, such as lint, are filtered in the lint filter assembly mounted on the lint filter cleaner 30 even through being introduced into the guide duct 15. Other foreign substances, i.e., bulky and hard foreign substances, are blocked by the blocking member 14 to remain in the drying drum 11. If substances other than lint are suctioned into the guide duct 15, the air blower 16 may be damaged or may generate a rattling sound in the exhaust duct 20. Therefore, it is necessary to prevent the foreign substances from leaving the drying drum 11 by the blocking member 14. In addition, the blocking member 14 may be detachably coupled to the front cabinet 12.

In addition, the lint filter cleaner 30 is connected to a washing water supply pipe 17 and a washing water drain pipe 18. An inlet end of the washing water supply pipe 17 may be mounted on the rear cabinet 13 and connected to a water pipe 2 connected from an external water supply source 1. An outlet end of the washing water supply pipe 17 is connected to an inlet port of a control valve 35 of the lint filter cleaner 30. An inlet end of the washing water drain pipe 18 is connected to a drain pump assembly (not shown) of the lint filter cleaner 30.

In addition, the air blower 16 includes a driving motor 161 rotating the drying drum 11 and a drying fan 162 connected to a rotational shaft of the driving motor 161.

The drying fan 162 is disposed at a side of the outlet end of the guide duct 15 to guide the air guided to the guide duct 15 through the drying drum 11 to the exhaust duct 20. In addition, the drying drum 11 rotates by a pulley (not shown) connected to the rotational shaft of the driving motor 161 and a belt wound around the pulley and an outer circumferential surface of the drying drum 11. That is, if the driving motor 161 is rotated, the pulley rotates, and when the pulley is rotated, the belt rotates the drying drum 11. With this structure, if the driving motor 161 operates, the drying drum 11 and the drying fan 162 are rotated in the same direction.

In addition, an electric heater is mounted inside the rear duct 19 of the dryer 10. The electric heater generates hot air by heating air to a high temperature before the air flowing into the suction duct 21 is introduced into the drying drum 11.

A drying process of the dryer 10 having the above configuration will be briefly described. First, the drying object is put into the drying drum 11 through an input hole 121 provided in the front cabinet 12. If a drying start command is input through the input unit 122, the air blower 16 operates, and the drying drum 11 and the drying fan 162 are rotated in one direction. The air flowing into the suction duct 21 is heated to a high temperature by the electric heater while flowing along the rear duct 19. The air heated to a high temperature is introduced into the drying drum 11 through the rear surface of the drying drum 11 along the rear duct 19. Here, the high-temperature dried air introduced into the drying drum 11 is changed into a high-temperature humid state while drying the drying object.

The high-temperature humid air is guided to the guide duct 15 through the blocking member 14 in a state of containing lint generated from the drying object. The high-temperature humid air guided to the guide duct 15 is guided to the exhaust duct 20 by the air blower 16. Here, the high-temperature humid air guided to the exhaust duct 20 filters the lint by the lint filter assembly while passing through the lint filter cleaner 30. In addition, the lint filter cleaner 30 operates to separate the lint attached to the lint filter assembly and discharge the lint to the outside by the drain pump assembly together with the washing water.

In addition, the processor 180 may control an overall operation of the dryer.

Figure 4:
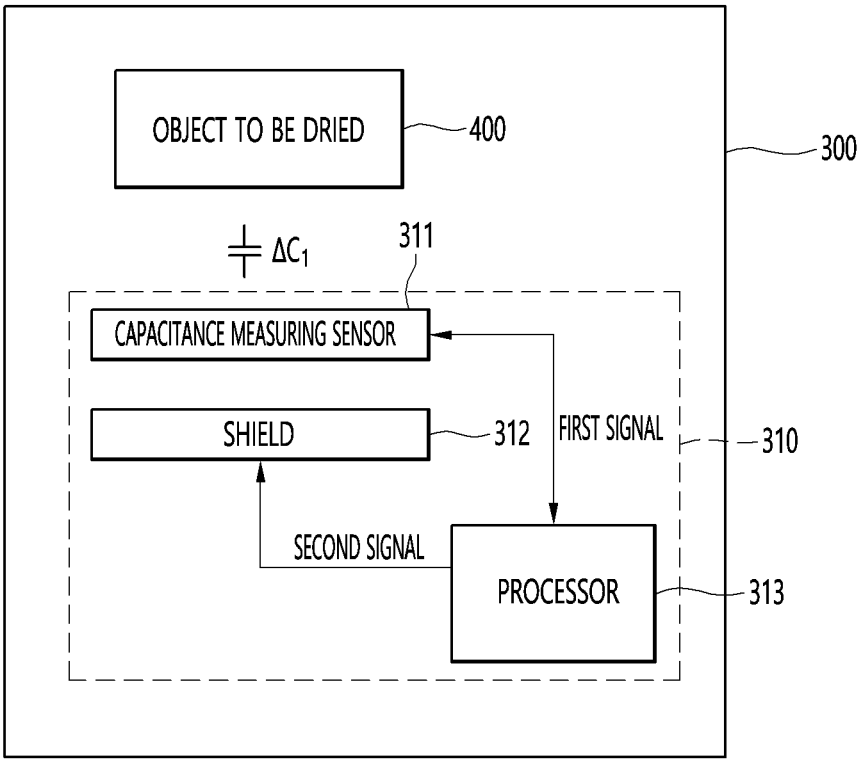
FIG. 4 is a block diagram for explaining an apparatus for measuring humidity for the dryer according to an embodiment.

FIG. 4 is a block diagram for explaining the apparatus for measuring the humidity for the dryer according to an embodiment.

As illustrated in FIG. 4, the dryer 300 may include an apparatus 310 for measuring humidity (hereinafter, referred to a humidity measuring apparatus) for a dryer 300, which is capable of removing noise with respect to a humidity measurement signal for the drying object 400 inside the dryer 300.

The humidity measuring apparatus 310 for the dryer may include a capacitance measuring sensor measuring a capacitance change amount $\Delta C_1$ that is changed due to the humidity of the drying object 400 put into the dryer 300, a shield 312 shielding noise generated in the dryer 300, and a processor 313 electrically connected to the capacitance measuring sensor 311 and the shield 312.

Here, the processor 313 may apply a second signal having the same waveform and the same voltage to the capacitance measuring sensor 311 and the shield 312 to measure capacitance according to a change in humidity based on the first signal output from the capacitance measuring sensor 311, thereby removing the noise.

That is, the processor 313 may apply a second signal having the same waveform and the same voltage to the capacitance measuring sensor 311 and the shield 312 and acquire a capacitance change amount based on the first signal output from the capacitance measuring sensor 311 to measure a humidity change amount of the drying object.

For example, the noise generated in the dryer 300 may include parasitic capacitance generated by temperature changes, movement, electromagnetic waves, static electricity, etc. inside the dryer 300, and the noise deteriorates accuracy in humidity measurement.

In addition, the capacitance measuring sensor 311 may set the drying object 400 as a virtual ground and set the capacitance measuring sensor 311 as a predetermined electrode to measure the capacitance change amount.

Also, the capacitance measuring sensor 311 may be disposed inside the dryer 300, and a sensing area may be opened in a direction in which the drying object 400 is disposed.

Here, the capacitance measuring sensor 311 may be disposed so that remaining areas other than the sensing area face the shield 312.

Also, the capacitance measuring sensor 311 may include an output pin outputting the first signal corresponding to the measured capacitance change amount to the processor 313.

For example, the output pin of the capacitance measuring sensor 311 may be disposed to face the shield 312 and may be electrically connected to an input pin of the processor 313 by a connection line.

Here, the connection line may be inserted into a through-hole passing through the shield 312 to electrically connect the output pin of the capacitance measuring sensor 311 to the input pin of the processor 313.

For another example, the output pin of the capacitance measuring sensor 311 may be disposed in a direction opposite to the shield 312 and may be electrically connected to the input pin of the processor 313 by the connection line.

Here, the connection line may be disposed to be exposed on an outer surface of the shield 312 to electrically connect the output pin of the capacitance measuring sensor 311 to the input pin of the processor 313.

Next, the capacitance measuring sensor 311 may be disposed on the shield 312 and insulated from the shield 312.

Here, an insulator or an insulating substrate may be disposed between the capacitance measuring sensor 311 and the shield 312, but this is merely an example and is not limited thereto.

In some cases, the capacitance measuring sensor 311 and the shield 312 may be disposed to be spaced apart from each other to have a predetermined interval by a spacer.

Here, in the spacer, the insulator or the insulating substrate may be disposed, but this is merely an example and is not limited thereto.

The shield 312 may be disposed between the input pin of the processor 313 and the capacitance measuring sensor 311, and the input pin of the processor 313 may receive the first signal output from the capacitance measuring sensor 311.

For example, at least one through-hole through which at least one connection line passes is defined in the shield 312, and the connection line may electrically connect the input pin of the processor 313 to the output pin of the capacitance measuring sensor 311.

In addition, the shield 312 may be disposed between the output pin of the processor 313 and the capacitance measuring sensor 311, and the output pin of the processor 313 may transmit the second signal having the same waveform and the same voltage to input pins of the capacitance measuring sensor 311 and the shield 312.

Here, the input pin of the processor 313 may be electrically connected to the capacitance measuring sensor 311 by the connection line to receive the first signal from the capacitance measuring sensor 311.

In addition, the processor 313 may be electrically connected to the capacitance measuring sensor 311 by a single connection line or a plurality of connection lines.

For an example, the processor 313 may receive the first signal from the capacitance measuring sensor 311 through the single connection line and may output the second signal to the capacitance measuring sensor 311.

For another example, the processor 313 may receive the first signal from the capacitance measuring sensor 311 through a first dedicated connection line and may output the second signal to the capacitance measuring sensor 311 through a second dedicated connection line.

Also, the input pin of the shield 312 may be electrically connected to the output pin of the processor 313 by the connection line.

In some cases, the input pin of the shield 312 may be exposed to the outside of the shield 312 and disposed to protrude in a direction of the output pin of the processor 313.

In addition, the capacitance measuring sensor 311 may include a front surface including the sensing area facing the drying object 400 and a rear surface opposite to the front surface, and the shield 312 may be disposed so that a top surface thereof faces a rear surface of the capacitance measuring sensor 311.

Here, in the shield 312, a first area corresponding to the top surface may be the same as a second area corresponding to the rear surface of the capacitance measuring sensor 311.

In some cases, in the shield 312, the first area corresponding to the top surface of the shield 312 may be greater than the second area corresponding to the rear surface of the capacitance measuring sensor 311.

If the area of the shield 312 is too large, it may be difficult to install the humidity measuring apparatus 310, and if it is too small, it may adversely affect the removal of the noise, and thus, it may be determined in consideration of design conditions.

In some cases, a groove having a predetermined depth may be defined in a central area of the top surface of the shield 312, and the capacitance measuring sensor 311 may be seated in the groove.

The reason is that, when the capacitance measuring sensor 311 is seated in the groove of the shield 312, the humidity sensing range of the capacitance measuring sensor 311 is adjusted to a specific area to measure the humidity of the drying object disposed on a specific area.

Here, in the shield 312, an area corresponding to a bottom surface of the groove may be the same as an area corresponding to the rear surface of the capacitance measuring sensor 311.

In this case, in the shield 312, the bottom surface of the groove may be insulated from the rear surface of the capacitance measuring sensor 311.

Also, in the shield 312, an inner surface of the groove may be insulated from a side surface of the capacitance measuring sensor 311.

In some cases, in the shield 312, an area corresponding to the bottom surface of the groove may be greater than an area corresponding to the rear surface of the capacitance measuring sensor 311.

Here, in the shield 312, the inner surface of the groove may be disposed to be spaced a predetermined distance from the side surface of the capacitance measuring sensor 311.

In this case, an insulator may be disposed in a space between the inner surface of the groove of the shield 312 and the side surface of the capacitance measuring sensor 311.

Also, in the shield 312, the bottom surface of the groove may be disposed to be spaced a predetermined distance from the rear surface of the capacitance measuring sensor 311.

In this case, an insulating substrate may be disposed in a space between the bottom surface of the groove of the shield 312 and the rear surface of the capacitance measuring sensor 311.

In addition, in the shield 312, a depth value of the groove may be greater than a height value of the capacitance measuring sensor 311 so that the front surface of the capacitance measuring sensor 311 is not exposed to the outside of the groove.

In some cases, in the shield 312, the depth value of the groove may be less than or equal to the height value of the capacitance measuring sensor 311 so that the front surface of the capacitance measuring sensor 311 is exposed to the outside of the groove.

Here, as the depth value of the groove of the shield 312 increases, the humidity sensing range of the capacitance measuring sensor 311 becomes narrower, and as the depth value of the groove the shield 312 decreases, the humidity sensing range of the capacitance measuring sensor 311 becomes wider.

As such, in the present disclosure, the humidity sensing range of the capacitance measuring sensor 311 may be adjusted by adjusting the depth of the groove of the shield 312 to accurately and precisely measure the humidity.

In addition, the shield 312 may be provided so that the inner surface of the groove is inclined at a predetermined inclination with respect to the bottom surface of the groove.

Here, the shield 312 may determine the sensing range of the capacitance measuring sensor 311 according to an angle between the inner surface of the groove and the bottom surface of the groove.

For example, the shield 312 may allow the angle between the inner surface of the groove and the bottom surface of the groove to increase to increase in sensing range of the capacitance measuring sensor 311, and allow the angle between the inner surface of the groove and the bottom surface of the groove to decrease so as to reduce the sensing range of the capacitance measuring sensor.

In some cases, in the shield 312, the inner surface of the groove may be perpendicular to the bottom surface of the groove.

Here, the shield 312 may be disposed so that the inner surface of the groove surrounds the side surface of the capacitance measuring sensor 311.

As an example, the shield 312 may be disposed so that, when the insulating substrate is disposed under the capacitance measuring sensor 311, the inner surface of the groove surrounds the side surface of the capacitance measuring sensor 311 and the side surface of the insulating substrate.

Next, the processor 313 may acquire the capacitance change amount $\Delta C_1$ in the direction of the drying object 400 measured from the capacitance measuring sensor 311.

Also, the processor 313 may measure the change in humidity of the drying object 400 based on the capacitance change amount.

Subsequently, the processor 313 may apply the second signal having the same waveform and the same voltage to the capacitance measuring sensor 311 and the shield 312 to measure capacitance according to a change in humidity based on the first signal output from the capacitance measuring sensor 311, thereby removing the noise.

For example, the processor 313 may output the second signal having the same waveform and the same voltage to the capacitance measuring sensor 311 and the shield 312 and may receive the first signal corresponding to the second signal from the capacitance measuring sensor 311.

Here, the first signal may be a signal having a waveform and voltage corresponding to the voltage applied to the capacitance measuring sensor 311 and may measure a capacitance change amount during discharge.

The processor 313 may output the second signal having the same waveform and the same voltage to the capacitance measuring sensor 311 and the shield 312 to remove parasitic capacitance between the drying object 400 and the capacitance measuring sensor 311.

For example, the processor 313 may simultaneously output the second signal having the same waveform and the same voltage to the capacitance measuring sensor 311 and the shield 312.

For another example, the processor 313 may output the second signal having the same waveform and the same voltage to the capacitance measuring sensor 311 and the shield 312 while the first signal is input from the capacitance measuring sensor 311.

For another example, the processor 313 may output the second signal having the same waveform and the same voltage to the capacitance measuring sensor 311 and the shield 312 while the first signal is output from the capacitance measuring sensor 311.

For another example, when the first signal is output from the capacitance measuring sensor 311, the processor 313 may receive the first signal through the connection line through which the second signal is output to the capacitance measuring sensor 311 or may receive the first signal through separate another connection line.

Here, the processor 313 may output the second signal for removing the noise to the capacitance measuring sensor 311 and the shield 312, based on a second signal having a preset waveform and voltage and a second signal having a pre-learned waveform and voltage.

For example, the processor 313 may input the capacitance change amount to a pre-trained neural network model to predict and output the signal having the waveform and voltage for the noise removal.

In this case, the neural network model may be pre-trained using the capacitance change amount inside the dryer 300 as an input value.

In addition, the dryer 300 according to the present disclosure may include constituents of an artificial intelligence device and perform a function of the artificial intelligence device.

Also, the term "dryer" may be used interchangeably with the term artificial intelligence dryer.

In addition, the processor 313 may collect history information including operation contents of the artificial intelligence device or user's feedback on the operation and may store the collected history information in a memory or a learning processor or transmit the collected history information to the external device such as an artificial intelligence server.

Here, the collected history information may be used to update a learning model.

The processor 313 may control at least part of the components of artificial intelligence device so as to drive an application program stored in memory. Furthermore, the processor 313 may operate two or more of the components included in the artificial intelligence device in combination so as to drive application program.

Throughout this specification, the terms the neural network, the network function, and the neural network may be used as identical means.

The above-described neural network model may be an artificial neural network (ANN) trained to output reconstructed data that is similar to the input data with respect to the input data. The artificial neural network (ANN) may be a model used in machine learning and may mean an overall model having problem-solving ability which is constituted by artificial neurons (nodes) that form a network through synaptic connection.

For example, the neural network model may be an autoencoder-based artificial neural network model. The autoencoder-based neural network model may include an encoder portion that dimensionally reduces the data by reducing the number of neurons in a hidden layer rather than the number of neurons in an input layer and a decoder part that reconstructs the data by dimensionally expanding the data from the hidden layer again and has an output layer having the same number of neurons as the number of neurons in the input layer, but is not limited thereto.

Also, the neural network model may be an artificial neural network model based on a generative adversarial network (GAN). The generative adversarial network (GAN) may be an artificial neural network in which a generator and a discriminator are adversarially learned, but is not limited thereto.

Also, the neural network model may be a deep neural network. A deep neural network (DNN) may refer to a neural network including a plurality of hidden layers in addition to an input layer and an output layer. The deep neural networks may be used to identify latent structures of data. That is, it may identify a potential structure of photos, texts, videos, voices, and music (e.g., what objects are in the photos, what the text and emotions are, what the texts and emotions are, etc.). The deep neural network may include a convolutional neural network (CNN), a recurrent neural network (RNN), a restricted boltzmann machine (RBM), and a deep belief network (DBN), a Q network, an U network, a Siamese network, and the like.

As described above, in the apparatus for measuring the humidity for the dryer according to the present disclosure, the noise on the measurement signal may be removed by using the capacitance measuring sensor and the active shield, and a signal-to-noise ratio may be minimized to accurately and precisely measure the humidity of the drying object.

In addition, in the apparatus for measuring the humidity for the dryer, a humidity sensing range may be adjusted to an optimal area by using the active shield to accurately and precisely measure the humidity of the drying object, which is disposed at the specific area.

Figure 5:
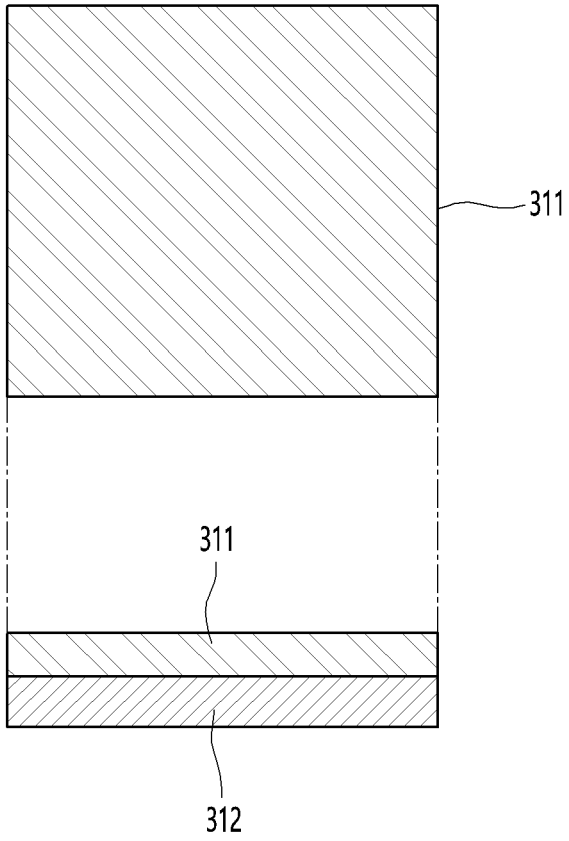
FIGS. 5 and 6 are views for explaining a size of a shield of the apparatus for measuring the humidity according to an embodiment.
Figure 6:
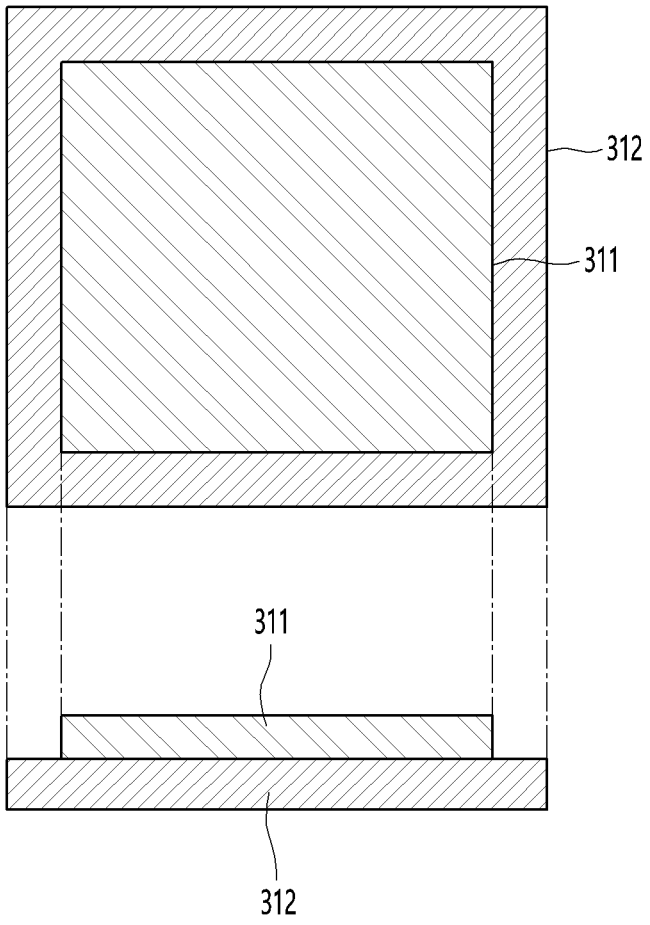

FIGS. 5 and 6 are views for explaining a size of the shield of the apparatus for measuring the humidity according to an embodiment.

Referring to FIGS. 5 and 6, the capacitance measuring sensor 311 may include a front surface including a sensing area facing the drying object and a rear surface opposite to the front surface, and the shield 312 may be disposed so that a top surface thereof faces a rear surface of the capacitance measuring sensor 311.

As illustrated FIG. 5, in the shield 312, a first area corresponding to the top surface may be the same as a second area corresponding to the rear surface of the capacitance measuring sensor 311.

In some cases, as illustrated in FIG. 6, in the shield 312, the first area corresponding to the top surface of the shield 312 may be greater than the second area corresponding to the rear surface of the capacitance measuring sensor 311.

If the area of the shield 312 is too large, it may be difficult to install the humidity measuring apparatus 310, and if it is too small, it may adversely affect the removal of the noise, and thus, it may be determined in consideration of design conditions.

Figure 7:
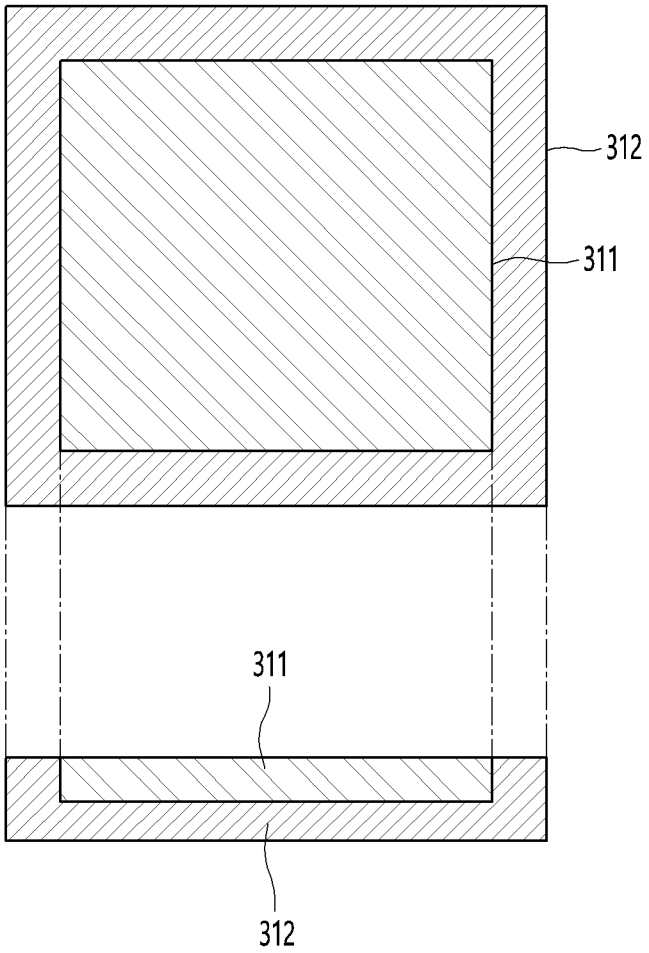
FIGS. 7 and 8 are views for explaining a shield groove of the apparatus for measuring the humidity for the dryer according to an embodiment.
Figure 8:
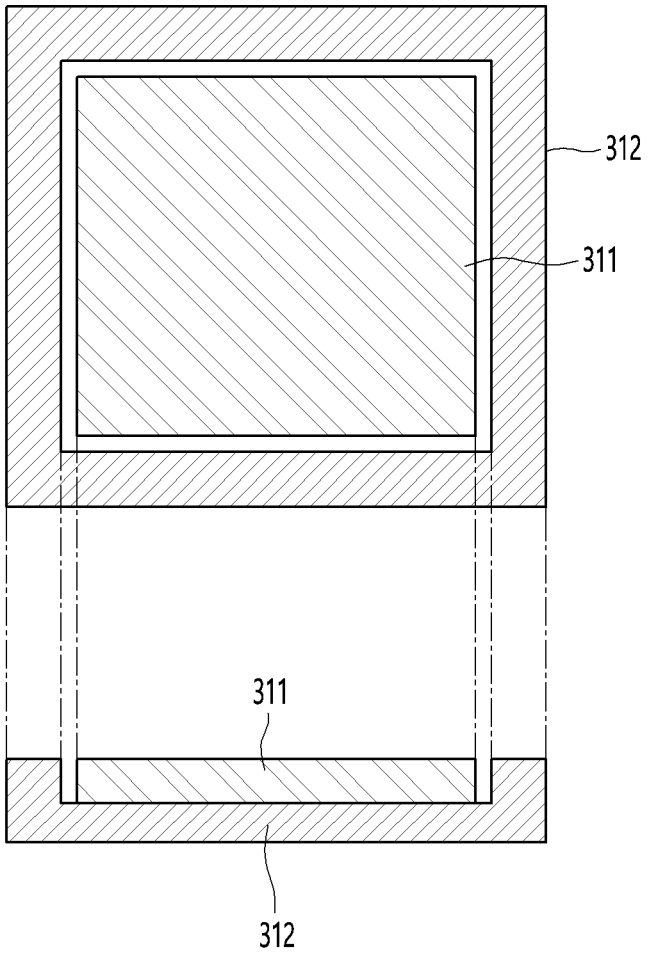

FIGS. 7 and 8 are views for explaining a shield groove of the apparatus for measuring the humidity for the dryer according to an embodiment.

As illustrated in FIGS. 7 and 8, a groove having a predetermined depth may be defined in a central area of the top surface of the shield 312, and the capacitance measuring sensor 311 may be seated in the groove.

The reason is that, when the capacitance measuring sensor 311 is seated in the groove of the shield 312, the humidity sensing range of the capacitance measuring sensor 311 is adjusted to a specific area to measure the humidity of the drying object disposed on a specific area.

As illustrated in FIG. 7, an area corresponding to a bottom surface of the groove may be the same as an area corresponding to the rear surface of the capacitance measuring sensor 311.

Here, in the shield 312, the bottom surface of the groove may be insulated from the rear surface of the capacitance measuring sensor 311, and the inner surface of the groove may be insulated from the side surface of the capacitance measuring sensor 311.

In some cases, as illustrated in FIG. 8, in the shield 312, an area corresponding to the bottom surface of the groove may be greater than an area corresponding to the rear surface of the capacitance measuring sensor 311.

Here, in the shield 312, the inner surface of the groove may be disposed to be spaced a predetermined distance from the side surface of the capacitance measuring sensor 311.

As such, in the present disclosure, as illustrated in FIGS. 7 and 8, the shield 312 may have a structure in which a groove is formed in a single body shape, and the capacitance measuring sensor 311 is seated in the groove.

Here, according to the change in area and depth of the groove of the shield 312 and the change in interval between the groove and the sensor electrode, the signal-to-noise ratio for the noise signal input in a horizontal direction may increase to increase in sensing distance.

As another case, the shield 312 according to the present disclosure may have a structure in which a flat first shield mounted on the bottom surface of the capacitance measuring sensor 311 and a ring-shaped second shield surrounding the side surface of the capacitance measuring sensor 311 are stacked.

Here, according to a change in width of the ring-shaped second shield of the shield 312 and a change in interval between the second shield and the sensor electrode, the signal-to-noise ratio may increase to increase in sensing distance.

Figure 9:
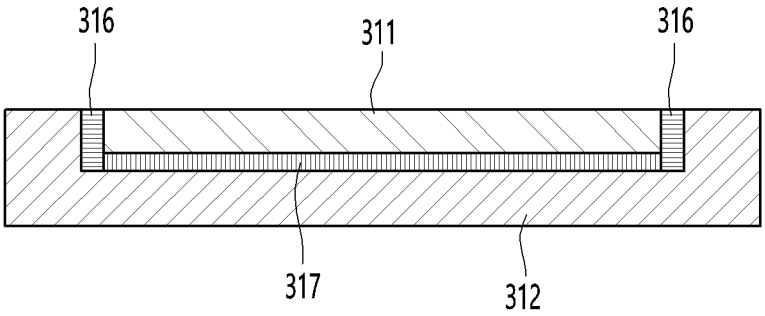
FIG. 9 is a view for explaining insulation between the shield and a capacitance measuring sensor of the apparatus for measuring the humidity according to an embodiment.

FIG. 9 is a view for explaining insulation between the shield and the capacitance measuring sensor of the apparatus for measuring the humidity according to an embodiment.

As illustrated in FIG. 9, a groove having a predetermined depth may be defined in a central area of the top surface of the shield 312, and the capacitance measuring sensor 311 may be seated in the groove.

Here, an insulator may be disposed in a space between the inner surface of the groove of the shield 312 and the side surface of the capacitance measuring sensor 311.

Also, in the shield 312, the bottom surface of the groove may be disposed to be spaced a predetermined distance from the rear surface of the capacitance measuring sensor 311.

Here, an insulating substrate 317 may be disposed in a space between the bottom surface of the groove of the shield 312 and the rear surface of the capacitance measuring sensor 311.

Figure 10:
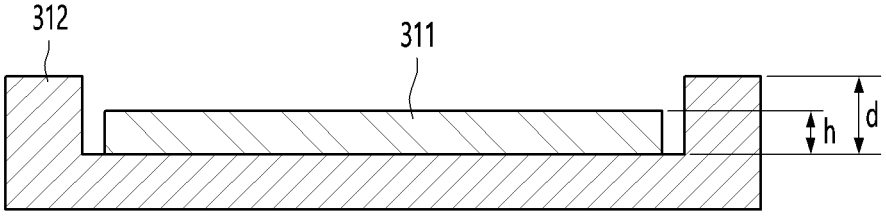
FIG. 10 is a view for explaining a depth of the shield groove of the apparatus for measuring the humidity according to an embodiment.

FIG. 10 is a view for explaining a depth of the shield groove of the apparatus for measuring the humidity according to an embodiment.

As illustrated in FIG. 10, a depth value d of the groove may be greater than a height value h of the capacitance measuring sensor 311 so that the front surface of the capacitance measuring sensor 311 is not exposed to the outside of the groove.

In some cases, in the shield 312, the depth valued of the groove may be less than or equal to the height value h of the capacitance measuring sensor 311 so that the front surface of the capacitance measuring sensor 311 is exposed to the outside of the groove.

Here, as the depth value d of the groove of the shield 312 increases, the humidity sensing range of the capacitance measuring sensor 311 becomes narrower, and as the depth value h of the groove the shield 312 decreases, the humidity sensing range of the capacitance measuring sensor 311 becomes wider.

As such, in the present disclosure, the humidity sensing range of the capacitance measuring sensor 311 may be adjusted by adjusting the depth value d of the groove of the shield 312 to accurately and precisely measure the humidity.

Figure 11:
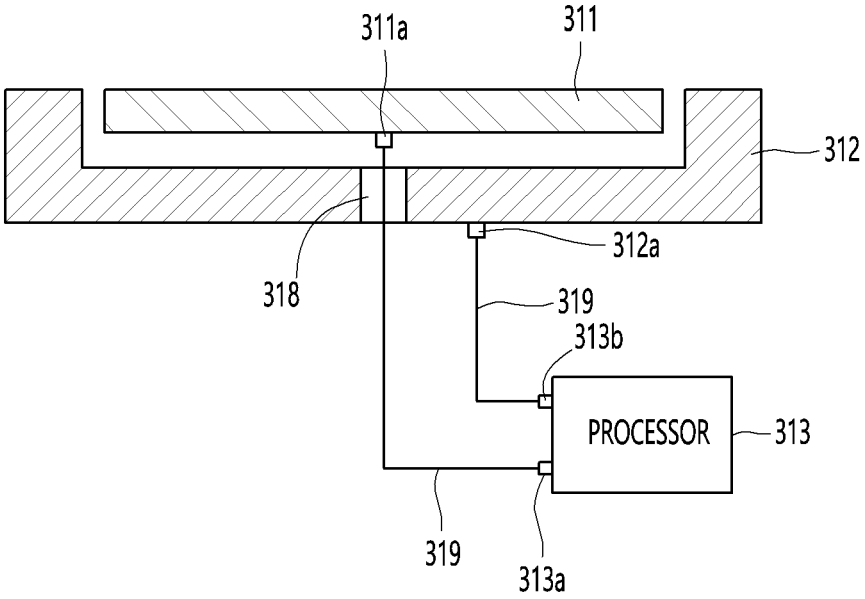
FIGS. 11 and 12 are views for explaining electrical connection of a processor of the apparatus for measuring the humidity according to an embodiment.
Figure 12:
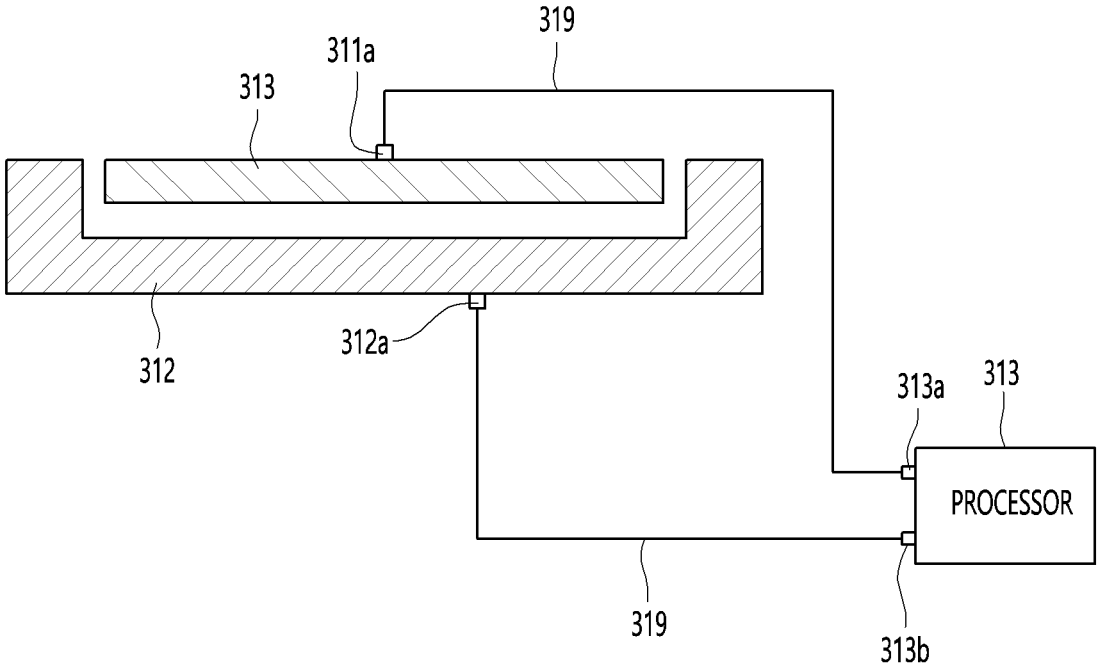

FIGS. 11 and 12 are views for explaining electrical connection of the processor of the apparatus for measuring the humidity according to an embodiment.

As illustrated in FIGS. 11 and 12, the capacitance measuring sensor 311 may include an output pin 311*a* outputting a first signal corresponding to the measured capacitance change amount to the processor 313.

For example, as illustrated in FIG. 11, the output pin 311*a* of the capacitance measuring sensor 311 may be disposed to face the shield 312 and be electrically connected to the input pin 313*a* of the processor 313 by a connection line 319.

Here, the connection line 319 is inserted into a through-hole 318 passing through the shield 312 to electrically connect an output pin 311*a* of the capacitance measuring sensor 311 to the input pin 313*a* of the processor 313.

For another example, the output pin 311*a* of the capacitance measuring sensor 311 may be disposed in a direction opposite to the shield 312 and may be electrically connected to the input pin 313*a* of the processor 313 by the connection line 319.

Here, the connection line 319 may be disposed to be exposed on an outer surface of the shield 312 to electrically connect the output pin 311*a* of the capacitance measuring sensor 311 to the input pin 313*a* of the processor 313.

Figure 13:
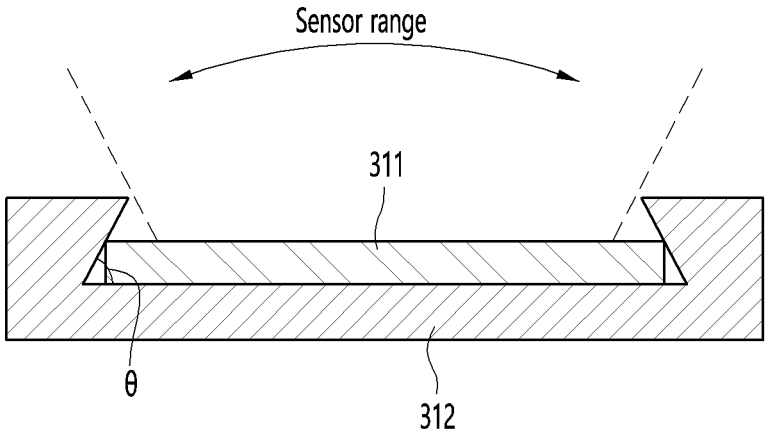
FIGS. 13 to 15 are views for explaining a sensing range of the apparatus for measuring the humidity according to an embodiment.
Figure 14:
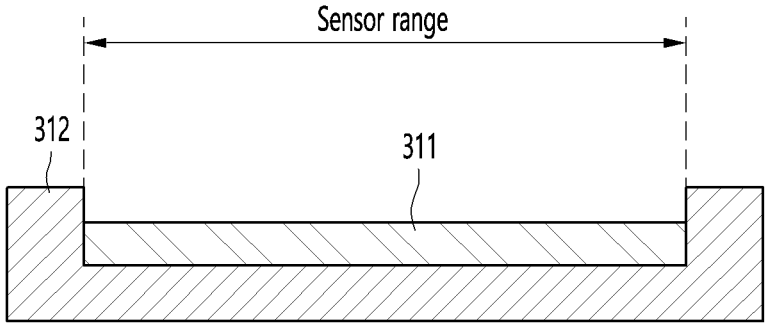
Figure 15:
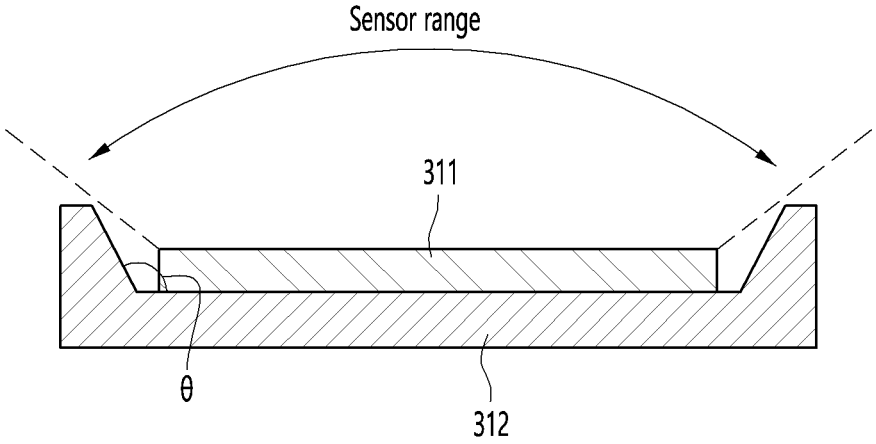

FIGS. 13 to 15 are views for explaining the sensing range of the apparatus for measuring the humidity according to an embodiment.

Referring to FIGS. 13 to 15, a groove having a predetermined depth may be defined in a central area of the top surface of the shield 312, and the capacitance measuring sensor 311 may be seated in the groove.

Here, in the shield 312, an inner surface of the groove may be defined to be inclined at a predetermined inclination with respect to a bottom surface of the groove, and the inner surface of the groove of the shield 312 may be disposed perpendicular to the bottom surface of the groove.

As such, the shield 312 may determine the sensing range of the capacitance measuring sensor 311 according to an angle θ between the inner surface of the groove and the bottom surface of the groove.

As illustrated in FIG. 13, when the angle θ between the inner surface of the groove and the bottom surface of the groove of the shield 312 is an acute angle, the capacitance measuring sensor 311 may have a first sensing range.

In addition, as illustrated in FIG. 14, when the angle θ between the inner surface of the groove and the bottom surface of the groove of the shield 312 is a right angle, the capacitance measuring sensor 311 may have a second sensing range wider than the first sensing range.

In addition, as illustrated in FIG. 15, when the angle θ between the inner surface of the groove and the bottom surface of the groove of the shield 312 is an obtuse angle, the capacitance measuring sensor 311 may have a third sensing range wider than the second sensing range.

As such, the shield 312 may allow the angle θ between the inner surface of the groove and the bottom surface of the groove to increase to increase in sensing range of the capacitance measuring sensor 311, and allow the angle θ between the inner surface of the groove and the bottom surface of the groove to decrease so as to reduce the sensing range of the capacitance measuring sensor.

Figure 16:
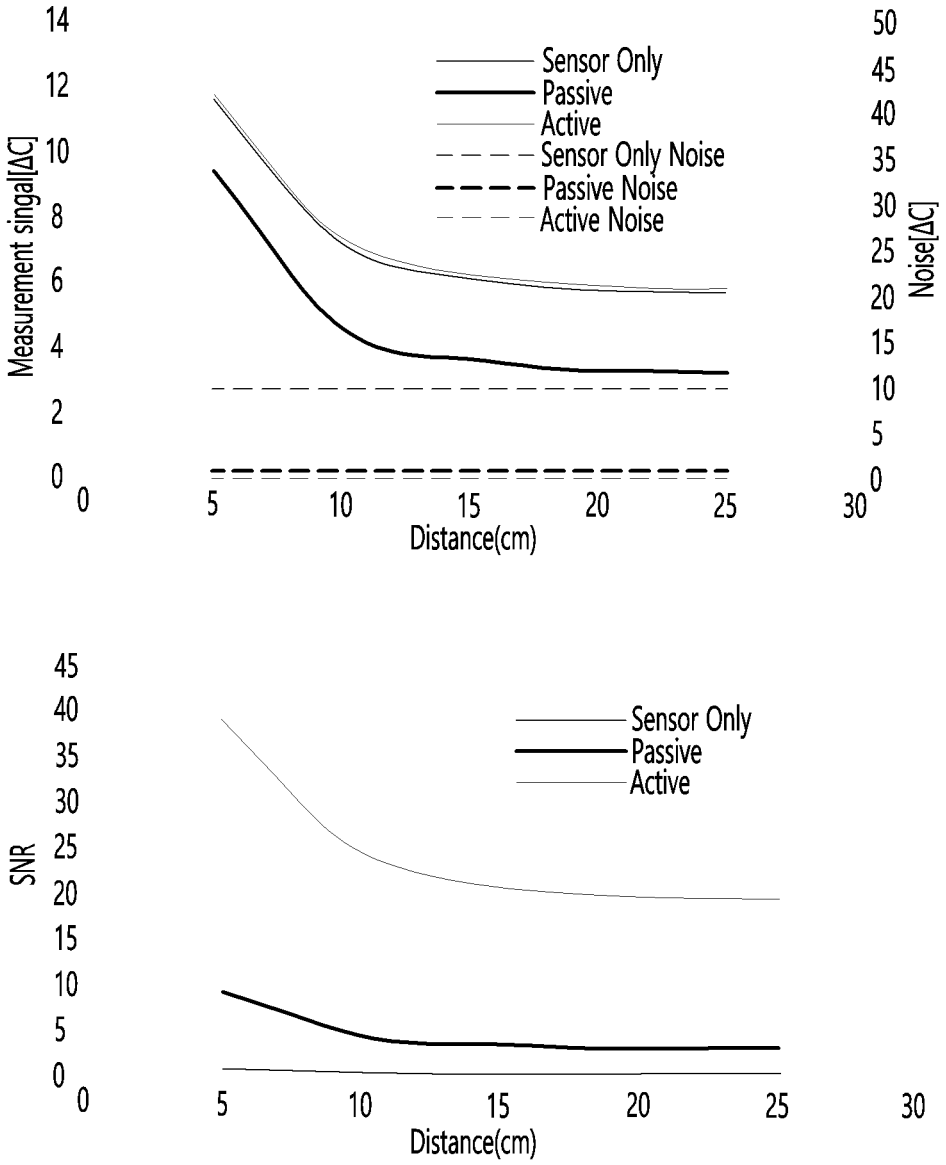
FIG. 16 is a view for explaining a sensing range corresponding to whether the apparatus for measuring the humidity is sealed and a shape of the shield according to an embodiment.

FIG. 16 is a view for explaining a sensing range corresponding to whether the apparatus for measuring the humidity is sealed and a shape of the shield according to an embodiment.

In the graph of FIG. 16, the term "sensor only" means a sensing range of the humidity measuring apparatus when there is only the measuring sensing electrode, the term "passive" means a sensing range of the humidity measuring apparatus when an area of the shield is the same as that of the capacitance measuring sensor, and the term "active" means a sensing range of the humidity measuring apparatus in which an area of the shield and an area of the capacitance measuring sensor are the same, and the same voltage is applied to the sensing electrode and the shield.

As illustrated in FIG. 16, in the sensing range of the humidity measuring apparatus in which the capacitance measuring sensor is seated in the groove of the shield, a magnitude of the signal is reduced, but the reduction of the noise increases, and thus, sensing sensitivity is improved based on the signal-to-noise ratio (SNR) to accurately and precisely measure the humidity.

In addition, the sensing range of the humidity measuring apparatus in which the capacitance measuring sensor is seated in the groove of the shield, and the same voltage is applied to the shield and the sensing electrode, removal of parasitic capacitance between the sensor and the shield and focusing of electric fields are performed to remove noise while maintain the magnitude of the signal and further improve sensing sensitivity based on the signal-to-noise ratio, thereby accurately and precisely measuring the humidity.

On the other hand, in the sensing range of the humidity measuring apparatus without the shield, sensing sensitivity for a specific area may be deteriorated, and noise may be generated, and thus, the humidity measurement may be inaccurate.

As such, in the present disclosure, since the signal-to-noise ratio is improved according to a sensing distance, the humidity may be precisely and accurately sensed.

As described above, in the apparatus for measuring the humidity for the dryer according to the present disclosure, the noise on the measurement signal may be removed by using the capacitance measuring sensor and the active shield, and a signal-to-noise ratio may be maximized to increase in humidity sensing distance, thereby accurately and precisely measuring the humidity of the drying object.

Figure 17:
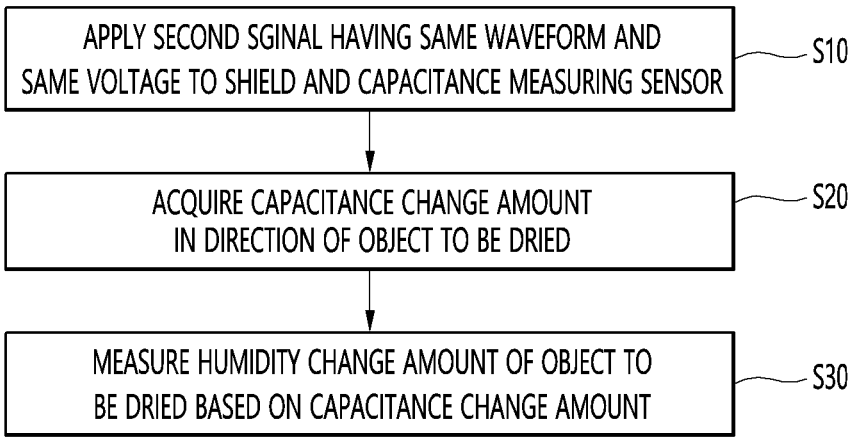
FIG. 17 is a flowchart for explaining a method for measuring humidity in the apparatus for measuring the humidity according to an embodiment.

FIG. 17 is a flowchart for explaining a method for measuring humidity in the apparatus for measuring the humidity according to an embodiment.

As illustrated in FIG. 17, a processor of a humidity measuring apparatus may apply a second signal having the same waveform and the same voltage to a capacitance sensor and a shield (S10).

Here, the processor may remove noise by applying a second signal having the same waveform and the same voltage to the capacitance sensor and the shield.

Here, the first signal may be a signal having a waveform and voltage corresponding to a capacitance change amount measured by the capacitance measuring sensor.

As such, the processor may output the second signal having the same waveform and the same voltage to the capacitance sensor and the shield to remove parasitic capacitance between a drying object and the capacitance measuring sensor.

Next, the processor may acquire the capacitance change amount measured by the capacitance measuring sensor (S20).

Here, the capacitance measuring sensor may measure the capacitance change amount by setting the drying object as a virtual ground and setting the capacitance measuring sensor as a predetermined electrode.

The processor may acquire the capacitance change amount from which noise including parasitic capacitance is removed.

Next, the processor may measure a change in humidity of the drying object based on the acquired change in capacitance (S30).

Here, the processor may measure a change in humidity of the drying object based on a change in capacitance from which the noise is removed and control a drying operation of a dryer based on the measured change in humidity of the drying object.

Figure 18A:
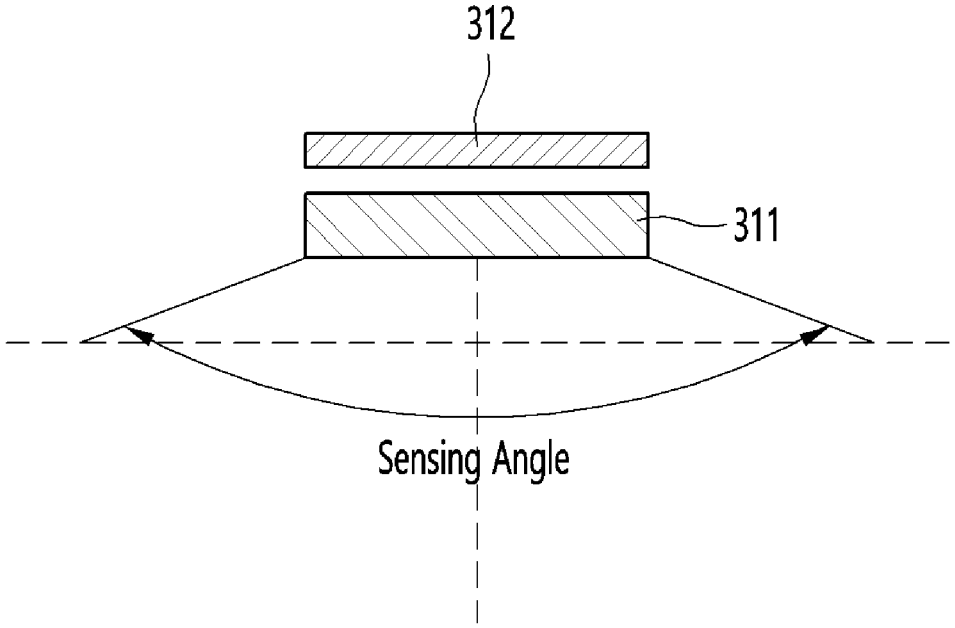
FIGS. 18A and 18B are views for explaining adjustment of the sensing range of the apparatus for measuring the humidity according to an embodiment.
Figure 18B:
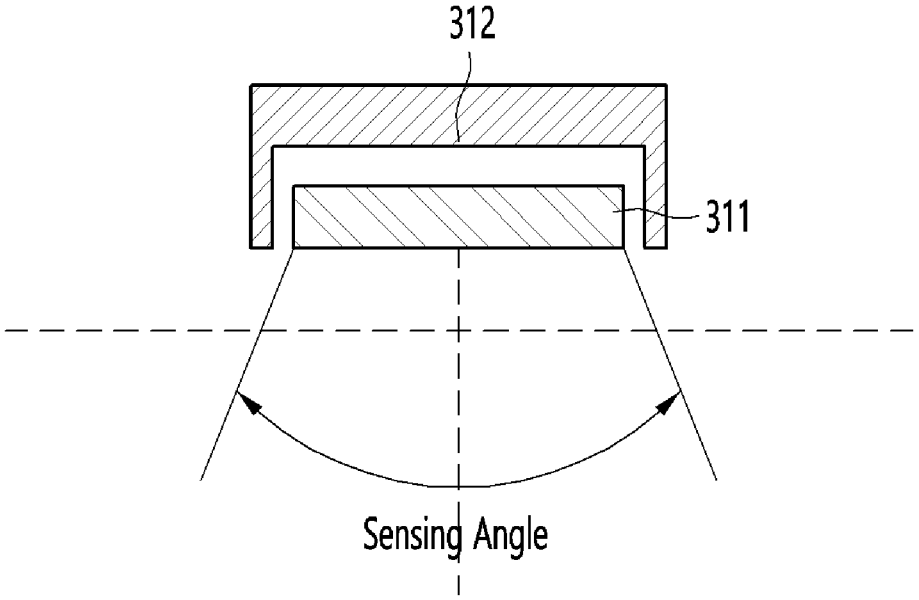

FIGS. 18A and 18B are views for explaining adjustment of a sensing range of the apparatus for measuring the humidity according to an embodiment.

As illustrated in FIG. 18A, in the humidity measuring apparatus according to the present disclosure, a shield 312 may be disposed on a rear surface of the capacitance measuring sensor 311.

Here, the rear surface of the capacitance measuring sensor 311 may be a surface facing a wall surface of the dryer, and the shield 312 may be disposed between the wall surface of the dryer and the capacitance specific sensor 311.

In addition, a front surface of the capacitance measuring sensor 311 may be a sensing surface facing a drying object and may sense humidity of the drying object at a first sensing angle.

Subsequently, as illustrated in FIG. 18B, in the humidity measuring apparatus according to the present disclosure, the shield 312 may be disposed on the rear surface and a side surface of the capacitance measuring sensor 311.

Here, the capacitance measuring sensor 311 may have a structure in which the rear and side surfaces of the capacitance measuring sensor 311 are covered by the shield 312 by being mounted in a groove of the shield 312.

In this case, a sensing angle of the capacitance measuring sensor 311 may be adjusted due to changes in electric fields in vertical and horizontal directions generated from the sensor electrodes.

That is, since the capacitance measuring sensor 311 mounted on the shield 312 of the structure (b) has a second sensing range less than a first sensing range of the capacitance measuring sensor 311 mounted on the shield 312 of the structure (a), the signal-to-noise ratio in the sensing area may be improved.

In addition, in the present disclosure, the sensing range according to a change in distance between the sensor electrode and the side shield 312 and a change in width of the sensor electrode and the side shield 312 may be adjusted.

As such, in the present disclosure, the structure of the shield 312 may be modified into various shapes, and thus, the sensing angle may be adjusted by adjusting the electric fields in the vertical and horizontal directions, and the signal-to-noise ratio may increase due to the width of the shield surrounding the side surface of the capacitance measuring sensor 311 and the change in interval therebetween.

Figure 19:
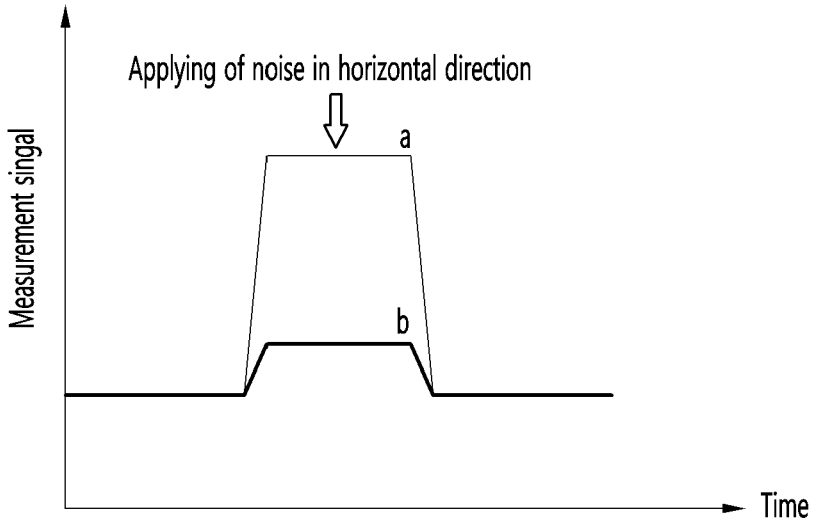
FIG. 19 is a graph for explaining an interference effect of a side surface of a sensor depending on whether a side shield of the apparatus for measuring the humidity is provided according to an embodiment.

FIG. 19 is a graph for explaining an interference effect of a side surface of a sensor depending on whether the side shield 312 of the apparatus for measuring the humidity is provided according to an embodiment.

As illustrated in FIG. 19, a humidity measuring apparatus b including the side shield 312 is less affected by sensor side interference when compared to a humidity measuring apparatus a, which does not include the side shield.

In the humidity measuring apparatus b including the side shield 312, the vertical and horizontal electric fields generated from the sensor electrode may be focused, and thus, the sensing angle may be less than that of the humidity measuring apparatus a, which does not include the side shield 312 to reduce noise generated in a lateral direction, thereby improving the signal-to-noise ratio (SNR) in the vertical direction.

As described above, in the apparatus for measuring the humidity for the dryer according to the present disclosure, the noise on the measurement signal may be removed by using the capacitance measuring sensor and the active shield, and a signal-to-noise ratio may be minimized to accurately and precisely measure the humidity of the drying object.

In addition, in the apparatus for measuring the humidity for the dryer, the humidity sensing range may be adjusted to an optimal area by using the active shield to accurately and precisely measure the humidity of the drying object, which is disposed at the specific area.

The embodiments of the present disclosure is to be considered illustrative, and not restrictive, and the technical spirit of the present disclosure is not limited to the foregoing embodiment.

Therefore, the scope of the present disclosure is defined not by the detailed description of the invention but by the appended claims, and all differences within the scope will be construed as being included in the present disclosure.

According to the humidity measuring apparatus for the dryer according to the present disclosure, the capacitance measuring sensor and the active shield may be used to remove the noise for the measurement signal and maximize the signal-to-noise ratio, thereby accurately and precisely measuring the humidity of the drying object, and thus, the industrial applicability is remarkable.

According to the embodiment, in the apparatus for measuring the humidity for the dryer, the noise on the measurement signal may be removed by using the capacitance measuring sensor and the active shield, and the signal-to-noise ratio may be minimized to accurately and precisely measure the humidity of the object to be dried.

In addition, according to the embodiment, in the apparatus for measuring the humidity for the dryer, the humidity sensing range may be adjusted to the optimal area by using the active shield to accurately and precisely measure the humidity of the object to be dried, which is disposed at the specific area.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus for measuring humidity for a dryer, the apparatus comprising:

a capacitance measuring sensor configured to measure an amount of capacitance change that is changed due to humidity of an object to be dried, the object having been put into the dryer, the capacitance measuring sensor having a sensing area opened in a direction of the object to be dried;

a shield configured to shield noise generated in the dryer; and a processor electrically connected to the capacitance measuring sensor and the shield, wherein the processor is configured to:

output a first signal from the capacitance measuring sensor;

apply a second signal having a specific waveform and a specific voltage to both of the capacitance measuring sensor and the shield; and acquire the amount of capacitance change, based on the first signal that is output from the capacitance measuring sensor so as to determine an amount of humidity change of the object to be dried.

2. The apparatus according to claim 1, wherein the capacitance measuring sensor is disposed so that areas other than the sensing area face the shield.

3. The apparatus according to claim 1, wherein the capacitance measuring sensor is disposed on the shield and is insulated from the shield.

4. The apparatus according to claim 1, wherein the shield is disposed between an input pin of the processor and the capacitance measuring sensor, wherein the input pin of the processor is configured to receive a first signal output from the capacitance measuring sensor.

5. The apparatus according to claim 1, wherein the capacitance measuring sensor comprises a front surface comprising the sensing area facing the object to be dried and a rear surface opposite to the front surface, and the shield is disposed so that a top surface of the shield faces the rear surface of the capacitance measuring sensor.

6. The apparatus according to claim 5, wherein, in the shield, a first area corresponding to the top surface is the same as a second area corresponding to the rear surface of the capacitance measuring sensor.

7. The apparatus according to claim 5, wherein, in the shield, a first area corresponding to the top surface is greater than a second area corresponding to the rear surface of the capacitance measuring sensor.

8. The apparatus according to claim 5, wherein, in the shield, a groove having a predetermined depth is defined in a central area of the top surface, and the capacitance measuring sensor is seated in the groove.

9. The apparatus according to claim 5, wherein the shield has a structure in which a flat-shaped first shield mounted on a bottom surface of the capacitance measuring sensor and a ring-shaped second shield configured to surround a side surface of the capacitance measuring sensor are stacked.

10. The apparatus according to claim 1, wherein the processor is configured to:

acquire the amount of capacitance change in a direction of the object to be dried.

11. The apparatus according to claim 1, wherein the processor is configured to simultaneously output the second signal to the capacitance measuring sensor and the shield.

12. The apparatus according to claim 11, wherein the first signal comprises a signal having a waveform and voltage, which correspond to the amount of capacitance change measured by the capacitance measuring sensor.

13. A method for measuring humidity in an apparatus for measuring humidity for a dryer, which comprises a processor electrically connected to a capacitance measuring sensor and a shield, the method comprising:

outputting a first signal from the capacitance measuring sensor;

applying a second signal having the same waveform and the same voltage to the capacitance measuring sensor and the shield;

acquiring an amount of capacitance change, based on the first signal that is output from the capacitance measuring sensor; and determining an amount of humidity change of an object to be dried, based on the acquired amount of capacitance change.

* * * * *